US011306548B2

(12) United States Patent
Morrow

(10) Patent No.: US 11,306,548 B2
(45) Date of Patent: Apr. 19, 2022

(54) FULL TUBING INNER-DIAMETER SPIN-THROUGH ROD CENTRALIZERS

(71) Applicant: HARRIER TECHNOLOGIES, INC., Greenwich, CT (US)

(72) Inventor: William Bruce Morrow, Santa Barbara, CA (US)

(73) Assignee: HARRIER TECHNOLOGIES, INC., Greenwich, CT (US)

( * ) Notice: Subject to any disclaimer, the term of this patent is extended or adjusted under 35 U.S.C. 154(b) by 39 days.

(21) Appl. No.: 16/712,665

(22) Filed: Dec. 12, 2019

(65) Prior Publication Data

US 2020/0190916 A1 Jun. 18, 2020

Related U.S. Application Data

(60) Provisional application No. 62/779,105, filed on Dec. 13, 2018.

(51) Int. Cl.
*E21B 17/10* (2006.01)

(52) U.S. Cl.
CPC ..... *E21B 17/1071* (2013.01); *E21B 17/1014* (2013.01); *E21B 17/1064* (2013.01)

(58) Field of Classification Search
CPC .. E21B 17/10; E21B 17/1078; E21B 17/1014; E21B 17/1064; E21B 17/1071
See application file for complete search history.

(56) References Cited

U.S. PATENT DOCUMENTS

| | | | | |
|---|---|---|---|---|
| 1,863,740 | A * | 6/1932 | Bettis | E21B 17/1042 166/241.4 |
| 2,045,629 | A * | 6/1936 | Bettis | E21B 17/1042 175/325.5 |
| 2,076,039 | A * | 4/1937 | Miller | E21B 17/1042 175/325.5 |
| 10,364,619 | B2 * | 7/2019 | Smith | E21B 33/1208 |
| 2014/0151026 | A1 * | 6/2014 | Andrigo | E21B 17/1042 166/241.6 |
| 2016/0177635 | A1 * | 6/2016 | Morrow | E21B 17/042 166/241.6 |
| 2016/0290068 | A1 * | 10/2016 | Riley | E21B 17/105 |

* cited by examiner

*Primary Examiner* — Nicole Coy
(74) *Attorney, Agent, or Firm* — The Roy Gross Law Firm, LLC; Roy Gross

(57) ABSTRACT

A spin-through drive rod centralizer consisting of a stator constructed of plastic, or other appropriate material, which is mounted on a rotor attached to the body of the drive rod, which provides the bearing surface for rotation of the rotor within the stator. The stator is equipped with multiple vanes which extend to the full internal diameter of the production tubing. In one configuration, the radially oriented vanes have cut-outs which allow the tip of the vane to compress inward, allowing passage through tight spots in the tubing, then rebounding to the full ID of the tubing. In another configuration, the vanes are tangentially attached to the stator body, such that they bend in a circumferential direction to allow passage through tubing tight spots, then rebound to full tubing ID.

16 Claims, 6 Drawing Sheets

FULL TUBING INNER-DIAMETER SPIN-THROUGH ROD CENTRALIZERS

CROSS REFERENCE TO RELATED APPLICATION

This application claims the benefit of priority of U.S. Provisional Application No. 62/779,105 entitled FULL TUBING INNER-DIAMETER SPIN-THROUGH ROD CENTRALIZERS and filed on Dec. 13, 2019. The contents of this application are incorporated by reference herein in their entirety.

FIELD OF THE INVENTION

The present invention relates to improvements in spin-through drive rod centralizers, and in particular to spin-through centralizers that are required to hold the rotating rods at the centerline of the production tubing.

FIELD OF INVENTION

Mechanical systems, for the removal of liquids from wells, that utilize a rotating rod string to transmit power to a down hole pump, such as progressive cavity pumps (PCP) and other types, may require standoff devices, referred to as centralizers, deployed along the rod string to prevent excessive wear between the rod string and the tubing. In systems which operate at high rotational speeds, these centralizers can function as stabilizers to provide, smooth, stable rotation of the rod string. FIG. 1 shows how these centralizers/stabilizers are attached to the rotating rod string within the production tubing.

Rod stand-off devices for rotational rod application are frequently a type of centralizer that allows the rods to spin within a fixed component or stator, and referred to as spin-through centralizers. The stators hold the rods near the centerline of the tubing via several vanes. Spin-through centralizers, usually consist of a plastic sleeve, or rotor, molded to the rod which turns with the rods within the stator, which consists of a cylindrical tubular body with three or four attached vanes. Spin through centralizers can also be configured with a stator that bears directly on the rod body, or within a special inter-rod coupling. However, whatever the configuration, all spin-through centralizers function similarly.

In operation, the stator remains more or less rotationally fixed within the tubing, with the inner surface bore through the tubular stator body acting as a bushing bearing on the surface of the rotor, which functions as the bearing journal. The materials used for the rotor and stator are chosen for both wear resistance and low coefficient of friction. Use of spin-through centralizers in rotational rod string drive systems results in better tubing and rod wear life, and lower power loss compared to uncentralized rods.

The most common use of spin-through centralizers is in progressive cavity pump (PCP) application. These centralizers are typically installed on the rod string either where there have been wear problems in an existing installation, or where a wear analysis program predicts potential problem areas in a new PCP installation. PCPs typically operate at less than 250-RPM drive speed, and with significant rod tension, as is characteristic of progressive pumping systems. Although the rod string is not truly rotationally stable, the relatively slow rotational speed and high rod tension have proven to result in satisfactory rod string rotational behavior, where rod string whip is not so severe as to cause rapid rod or tubing failure. In most PCP applications, rod centralizers are positioned only where actual wear or potential wear has been identified.

In some rotational rod driven systems, the rod rotational speed is much higher than is typical with PCPs, and satisfactory rod rotational stability can only be achieved by appropriately spacing centralizers along the rod string. Installation of too few centralizers too widely spaced results in severe vibration of the rods, which worsens as input speed is increased. This rotational instability can result in rod-tubing contact, and/or premature wear of the centralizers, usually the stators. It is therefore important to ensure that the critical rotational speed of the rod string at the installed rod centralizer spacing is greater than the input rotational drive speed. For example, at 500-RPM input drive speed with little rod tension, the unsupported length of 1" diameter solid steel rod, i.e., the centralizer spacing, must be no greater than 8.1 feet. At 1000 RPM, the centralizer spacing should not exceed 5.8 feet, and at 3500 RPM the spacing between centralizers drops to 3.0 feet.

Oilfield tubulars have significant variation in internal diameter. For example, 3½", 9.30 lb/ft EUE tubing has a specified internal diameter of 2.992", However, the drift diameter, which is the manufacturer's guaranteed minimum ID, is 2.867"—fully ⅛" or 4% less than the specified diameter. Because of this, commercially available spin-through centralizers have an effective outer diameter that is less than the specified internal diameter of the tubing they are designed for. This is done so that the rod centralizers can pass through the occasional 'tight', e.g. 'drift diameter', spots in the tubing while running the rod string. Were the centralizers made to snuggly fit the specified ID of the tubing, the string would be nearly impossible to run without damaging many of the centralizers, as the likelihood of encountering one or more drift diameter tight spots, where the centralizers could not pass without damage, would be high. One consequence of this loose fit is the centralizer has significant radial play within the tubing.

In the high rotational speed, the undersized OD of the centralizers, even if spaced properly for rotational stability (i.e., at less than critical spacing), causes rod string vibration and excessive wear of the centralizer rotor. The problem is that the centralizers do not hold the rods at the center of the tubing, and hence are not fixed points in the rotating rod string. Consequently, the rods can move both radially and circumferentially within the tubing. If the centralizers are radially fixed within and at the center of the tubing, they can effectively isolate lengths of rod between them that are shorter than the maximum length allowable for stable rotation. If the centralizers do not fit snuggly within the tubing, they allow the rod to freely move off-center, and the length of unsupported rod is no longer the distance between adjacent centralizers, and stable rotation will not occur. Instead, the rods will whip around at the centralizer locations. Whipping is defined as the rod orbiting a point in the center of the tubing, with the diameter of the orbit roughly equal to the difference between the ID of the tubing and the effective OD of the centralizer stator.

The current invention addresses the problem, with a centralizer stator design that provides snug, full tubing ID fit, maintaining the rod location near or at the exact center of the production tubing, yet with the ability to be run through areas of the tubing with reduced 'drift' ID without damage.

SUMMARY OF THE INVENTION

The principal object of the current invention is to provide a spin through centralizer for a rotating rod string with a stator that has an effective outside diameter that is equal or very nearly equal to the manufacturer's specified inside diameter of the production tubing, and holds the rod string at the centerline of the production tubing A further object is to provide a centralizer stator as set forth above, with sufficient flexibility in the stator blades to allow the passage of said stator past areas of the tubing where the effective inside diameter is less than the specified ID of the tubing, i.e. where the tubing ID is equal to or greater than the so-called 'drift' diameter, without damaging the centralizer components, and without interfering with the installation of the rod string into the production tubing.

A further object is to provide a centralizer as set forth above where the stator blades rebound back to full original OD after multiple flexing to allow passage through 'drift' diameter areas of the tubing, returning the drive rod to the centerline of the production tubing.

Objects of the invention are achieved by providing a drive rod centralizer to position the drive rods at the centerline of the production tubing, comprising: a cylindrical rotor, said cylindrical rotor being attached to the body of said drive rod, the centerline of said cylindrical rotor being collinear with the centerline of said drive rod; a stator, said stator being comprised of a cylindrical body, said cylindrical body having an external diameter less than the internal diameter of said production tubing, and having a smooth central bore, said bore having an internal diameter larger than the external diameter of said cylindrical rotor; wherein said stator is installed on said drive rod such that said rotor is within said central bore of said stator; wherein said stator has several, equal length vanes projection radially outward from said cylindrical body, with the major axis of said vanes being oriented along the centerline of said stator body, the axial length of said vanes being approximately equal to the axial length of said stator body; wherein the body of said vanes are of roughly rectangular solid shape, the radially inner surface of said vane being attached to the outer surface of said stator body, the radially outer surface of said vane being in contact with the inner surface of said production tubing; wherein some material of the body of some of said vanes is removed, forming a cavity in some of said vanes.

In certain embodiments, the cavity is formed completely through said vane in the circumferential direction.

In certain embodiments, the cavity allows tips of vanes to deform inward toward the center of the tubing when the vanes are flexed In certain embodiments, the vanes are flexed when a tight spot is encountered in the production tubing.

In certain embodiments, the vanes are made of a material that has natural elasticity, such that the vanes rebound to their full tubing outer diameter.

In certain embodiments, the vanes are deformed in the radial direction

In certain embodiments, the vanes are bent in a roughly circumferential direction In certain embodiments, the production tubing has a reduced effective inside diameter In certain embodiments, the vanes are configured to be compressible due to the cavity in said vanes In certain embodiments, the cavity is fully enclosed, such that cavity is not exposed to an outer surface of each of the vanes In certain embodiments, the cavity has a bore, such that the bore exposes the cavity to an outer surface of each of the vanes In certain embodiments, the vanes are configured to flex from a first position to a second position in a circumferential direction.

In certain embodiments, the vanes are configured to rebound back to the first position in the circumferential direction.

In certain embodiments, the effective outside diameter of the stator is equal or very nearly equal to the manufacturer's specified inside diameter of the production tubing, and holds the rod string at the centerline of the production tubing In certain embodiments, the drive rod centralizer allows for sufficient flexibility in the stator blades to allow the passage of said stator past areas of the production tubing where the effective inside diameter is less than the specified internal diameter of the tubing without damaging the centralizer components, and without interfering with the installation of the rod string into the production tubing In certain embodiments, the stator blades rebound back to full original OD after multiple flexing to allow passage through 'drift' diameter areas of the tubing, returning the drive rod to the centerline of the production tubing.

In certain embodiments, each of said vanes includes a cavity.

Other objects of the invention are achieved by providing a drive rod centralizer to position the drive rods at or near the centerline of the production tubing, comprising: a cylindrical rotor, said cylindrical rotor being attached to the body of said drive rod, the centerline of said cylindrical rotor being collinear with the centerline of said drive rod; a stator, said stator being comprised of a cylindrical body, said cylindrical body having an external diameter less than the internal diameter of said production tubing, and having a smooth central bore, said bore having an internal diameter larger than the external diameter of said cylindrical rotor; wherein said stator is installed on said drive rod such that said rotor is within said central bore of said stator; wherein said stator has several, equal length vanes attached to the outer surface of said cylindrical body of said stator; wherein said vanes are of roughly rectangular solid shape, said vanes being attached to said stator body such that the outer circumferential surface of said vanes is tangential with the cylindrical surface of said stator; wherein the radially outer surface of said vanes is in contact with the inner surface of said production tubing.

Other objects of the invention are achieved by providing a stator for a drive rod centralizer, comprising: a cylindrical body, said cylindrical body and having a smooth central bore, one or more vanes attached to the outer surface of said cylindrical body of said stator, wherein some material of the body of said one or more vanes is removed, forming a cavity within the body of said one or more vanes.

In certain embodiments, the body of said one or more vanes are of roughly rectangular solid shape, the radially inner surface of said one or more vanes is attached to the outer surface of said stator body, the radially outer surface of said one or more vanes being in contact with the inner surface of a production tubing of drive rods.

Other objects of the invention and its particular features and advantages will become more apparent from consideration of the following drawings and accompanying detailed description. It should be understood that the detailed description and specific examples, while indicating the preferred embodiment of the invention, are intended for purposes of illustration only and are not intended to limit the scope of the invention.

DETAILED DESCRIPTION OF THE INVENTION

Figure 1:
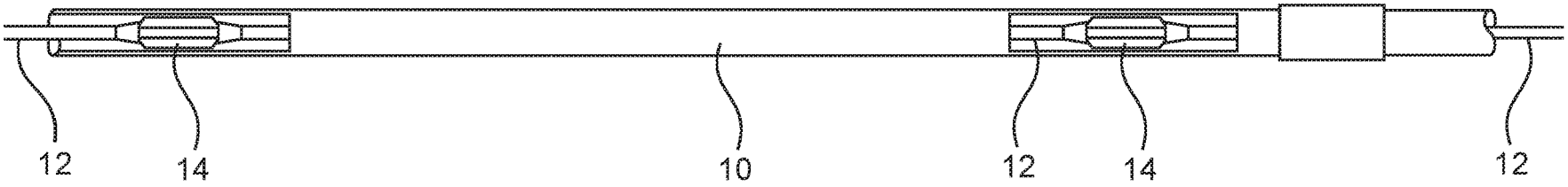
FIG. 1 (Prior Art)
FIG. 1 shows a prior art drive rod string within production tubing with cut-outs showing spin-through centralizers attached to the drive rod.
Figure 2:
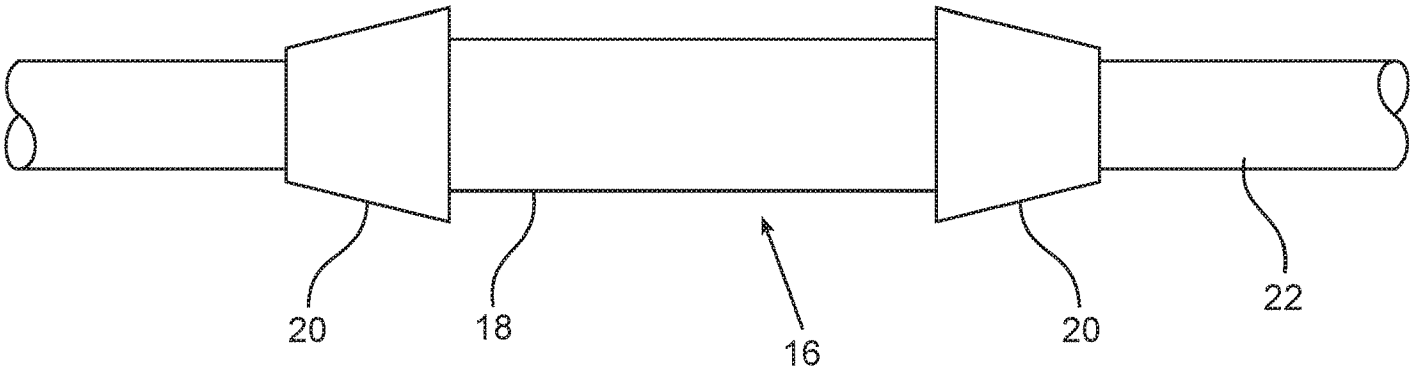
FIG. 2 (Prior Art)
FIG. 2 shows a side view of a typical prior art spin-through centralizer rotor molded onto the production tubing.
Figure 3:
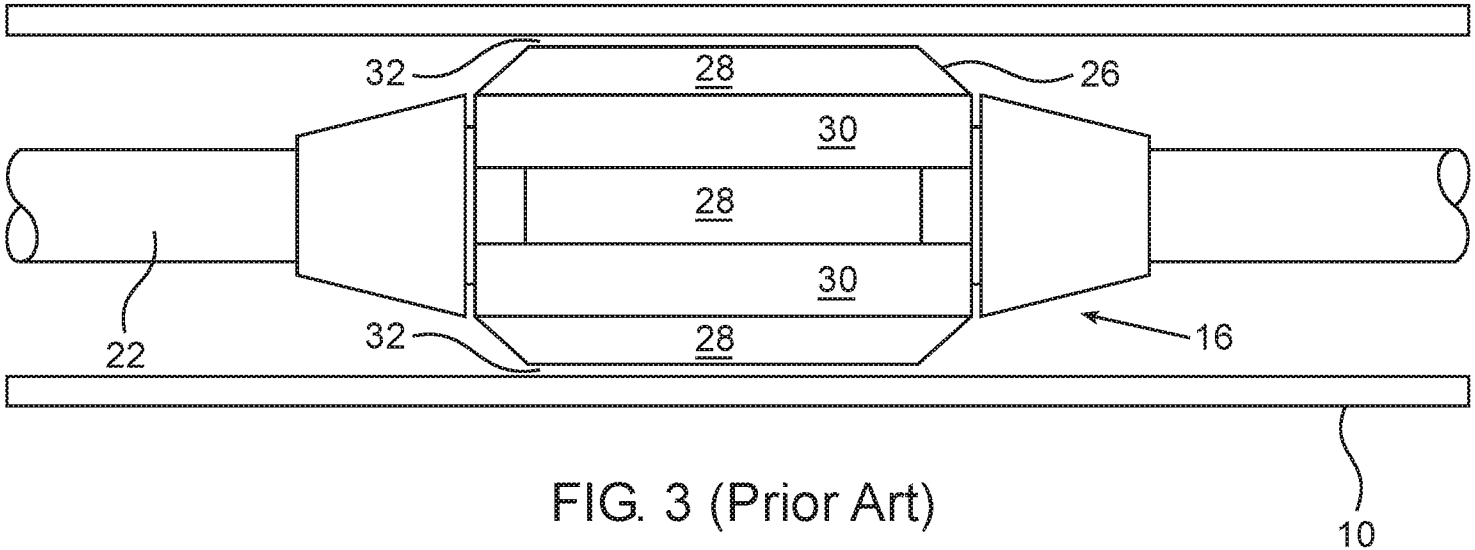
FIG. 3 (Prior Art)
FIG. 3 shows the components of a prior art commercially available spin-through centralizer.
Figure 4:
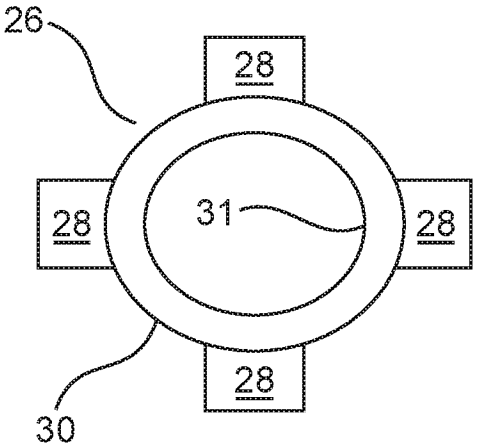
FIG. 4 (Prior Art)
FIG. 4 shows the end view of a prior art stator of a commercially available spin-through centralizer.

The present invention is directed at the so-called spin-through rod centralizers as employed in devices which drive a downhole pump via a rotating rod string. FIG. 1 shows a side view of a section of production tubing 10, with cut-out revealing the drive rod string 12, with installed spin-through centralizers 14. The principal components of a spin-through centralizer are the rotor affixed to the rod, which forms the bearing journal (plain bearing) of the device, and the stator, which performs the dual function of centralizing the rod string inside the production tubing, and providing a bearing surface or bushing for the rotor. FIG. 2. shows a typical rotor 16, consisting of a journal portion 18, and end stops 20, molded on to the drive rod body, 22. FIG. 3 shows a side view an assembled spin-through centralizer inside production tubing 10. The stator 26 mounted onto the rotor 16, consisting of several vanes 28 affixed to the stator body 30. Note the gap 32 between the outer edge of the vanes and the inside diameter of the production tubing. FIG. 4 is an end view of an unmounted stator 26, showing vanes 28 and stator body 30, and bearing surface 31. Another type of spin-through centralizer utilizes a modified coupling between rods that provides a steel journal onto which a stator, similar to that described above, is mounted.

Figure 6:
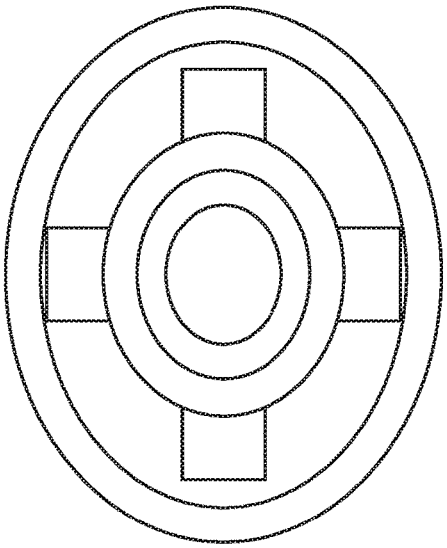
FIG. 6 (Prior Art)
FIG. 6 shows a cross sectional view of a prior art commercially available spin-through centralizer within production tubing with reduced effective inner diameter.
Figure 5:
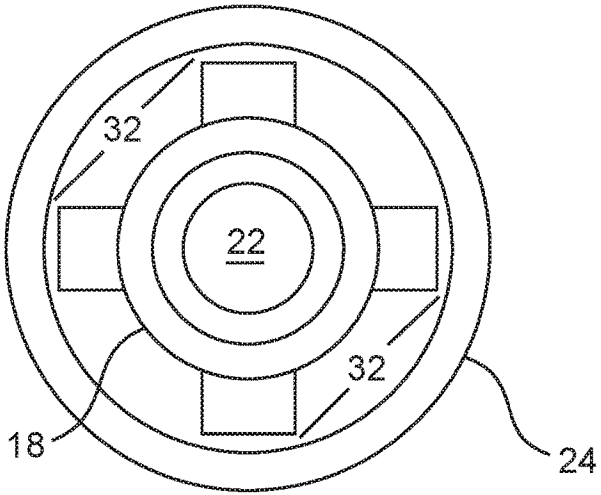
FIG. 5 (Prior Art)
FIG. 5 shows a cross sectional view of prior art commercially available spin-through centralizer within the production tubing.

In any of these existing spin-through centralizers, the effective OD of the stator is somewhat less than the manufacturer's specified ID of the production tubing forming a gap 32 as shown in FIG. 3, to allow the passage of the centralizer through areas of the tubing that are less than the specified ID. This gap is shown clearly in FIG. 5, a cross-section through the production tubing and centralizer. This gap is necessary in the current designs because the vanes have very little flexibility in the radial direction, and hence, to pass the common 'tight' spots in normal production tubing, must have an effective OD equal to or less than the smallest expected ID of the tubing—the so called 'drift' diameter. This tight spot situation is shown in FIG. 6, a cross-section similar to FIG. 5, but with the tubing 24 deformed, ovalized in this case, such that the minimum diameter of the tubing is reduced to the drift diameter. The centralizer stator just fits within this reduced diameter. Were the vanes' radial extent any greater, the centralizer would jam in the tubing, preventing further vertical movement.

The present invention is a modification of the vane configuration that allows enough flexibility for the centralizer to pass the 'tight' spots, yet rebound back to full inside diameter of the tubing after passing these spots of reduced diameter. This flexibility can be accomplished in two principal ways: deformation of the vanes in the radial direction, and bending of the vanes in a roughly circumferential direction.

Figure 7:
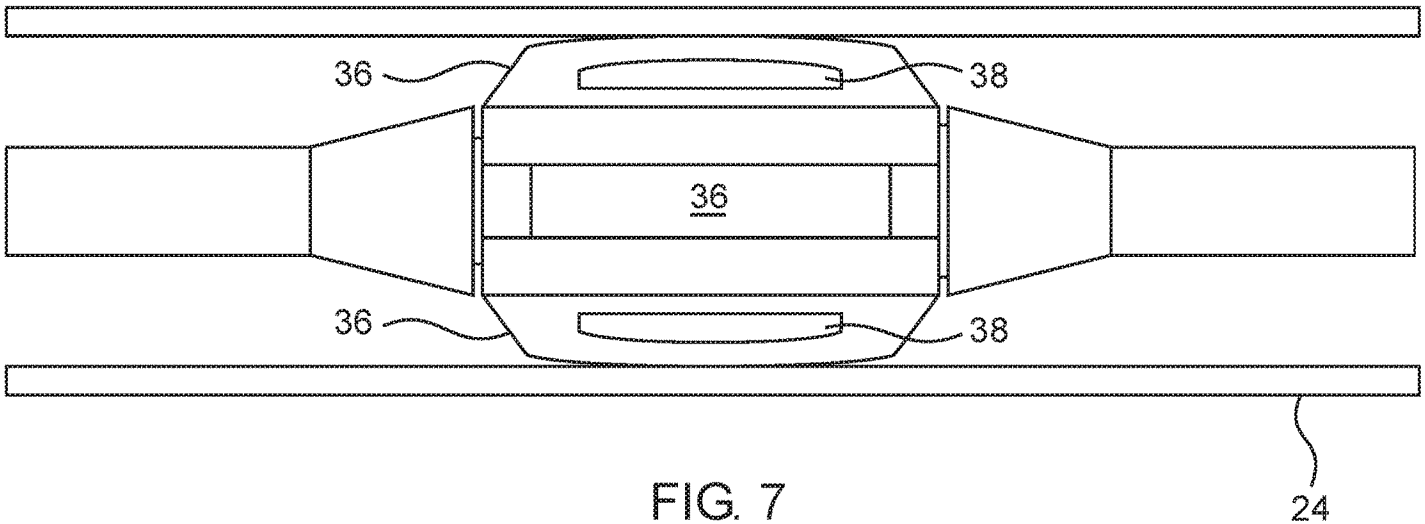
FIG. 7. shows a spin-through centralizer incorporating the radially flexible stator vane feature of the present invention.
Figure 8:
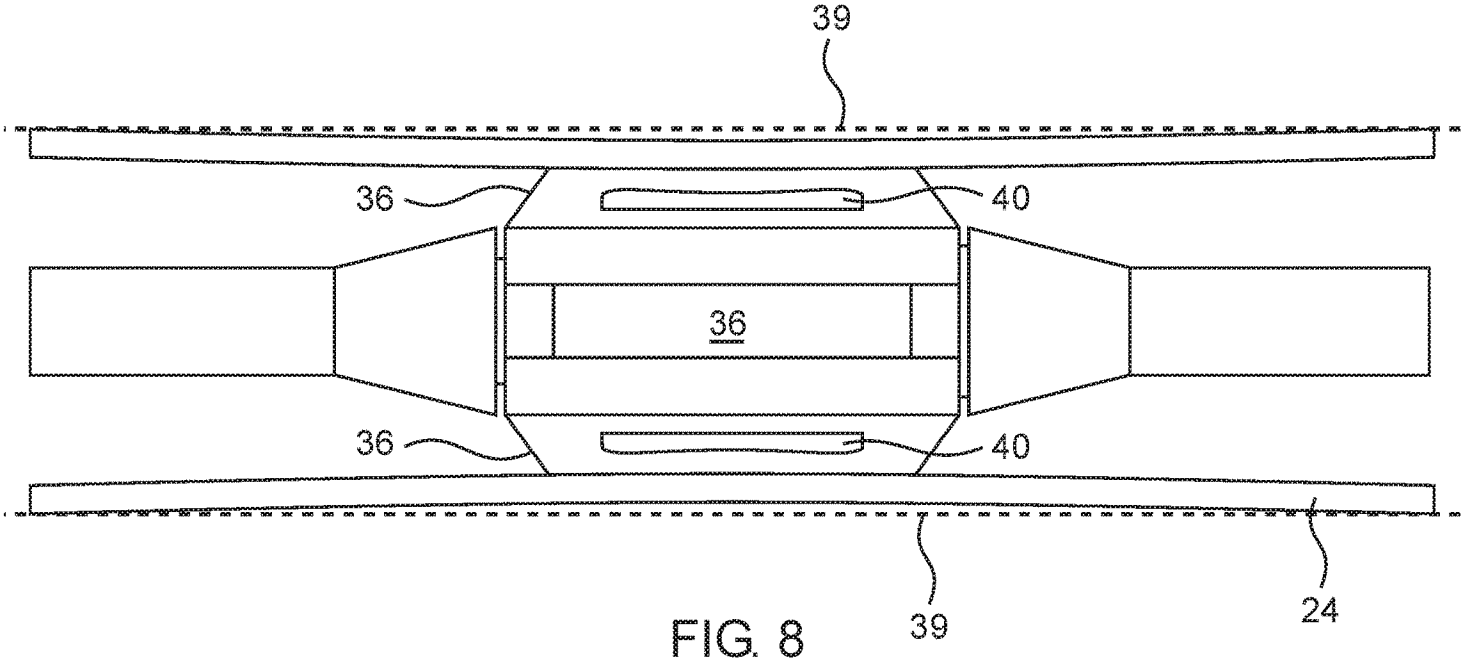
FIG. 8 shows the FIG. 7 centralizer with the stator vanes radially deformed by a reduced diameter tight spot in the production tubing.

FIG. 7 shows a centralizer stator configuration that allows diametrical variation via radial deformation of the vanes. The vanes 36, which extend radially to the full extent of the tubing ID as shown, have a cutout 38 that allows the vane tips to deform inward toward the center of the tubing when a tight spot is encountered. FIG. 8 shows that situation, where the tubing 24 has a reduced effective inside diameter. Full tubing outer diameter is shown by the dashed lines 39. The vanes 36 deform, with the vane tips flexing inward by compressing cutout 38, to squeeze past the tight spot. After passing the tight spot, the natural elasticity of the vane material allows the vane tips to rebound to their normal, full tubing OD extent.

Figure 10:
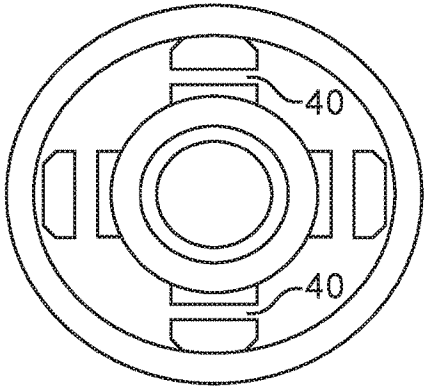
FIG. 10 shows a cross sectional view of the FIG. 7 spin-through centralizer within production tubing with reduced effective inner diameter.
Figure 9:
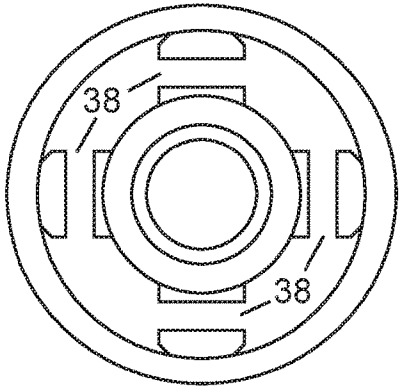
FIG. 9 shows a cross section through the FIG. 7 centralizer within the production tubing.

This full tubing inside diameter fit of the FIG. 7 centralizer, as well as the cutouts 38 in the vanes 36 are shown clearly in FIG. 9, a cross-section through the production tubing and centralizer. FIG. 10. in a similar fashion as FIG. 6. above, shows a cross section through the tubing and centralizer in a tubing 'tight spot'. Note how the vane tips opposite the 'tight spot' are compressed, reducing the size of the cutout to 40, and allowing the centralizer to squeeze past the tubing diameter reduction.

Figure 11:
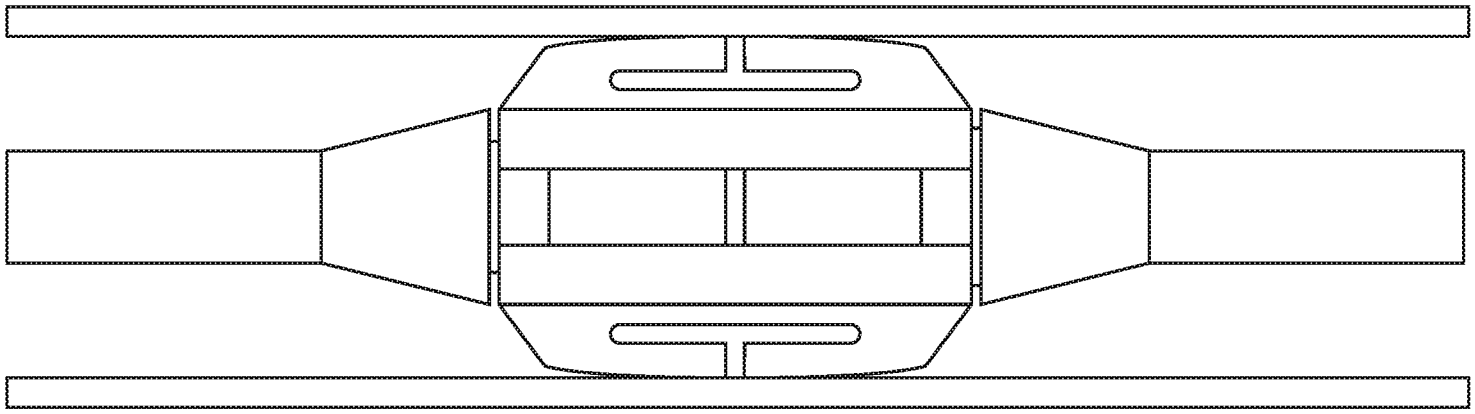
FIG. 11 shows a side view of an alternative configuration of a spin-through centralizer incorporating the radially flexible stator vane feature of the present invention.

Other vane configurations can be devised by those skilled in the art to allow the needed radial flexibility to pass undamaged through the tight spots then return to full size after passing. One such alternative is shown in FIG. 11.

Figure 12:
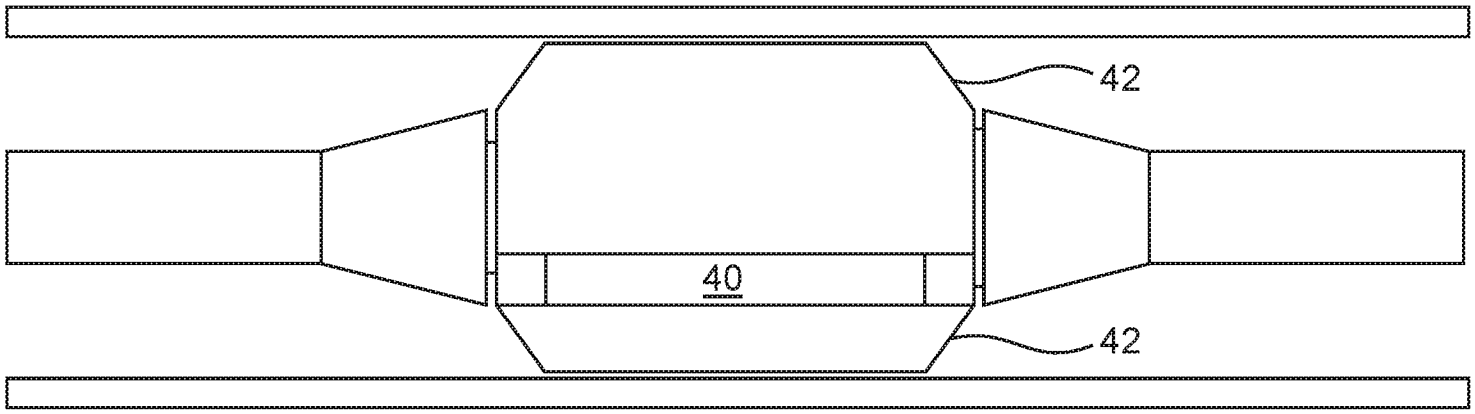
FIG. 12 shows a side view of a spin-through centralizer with a stator configuration that provides radial flexibility via circumferential bending of the stator vanes.
Figure 14:
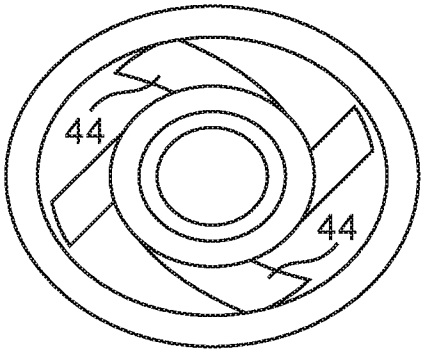
FIG. 14 shows the FIG. 8 configuration passing through a tubing tight spot.
Figure 13:
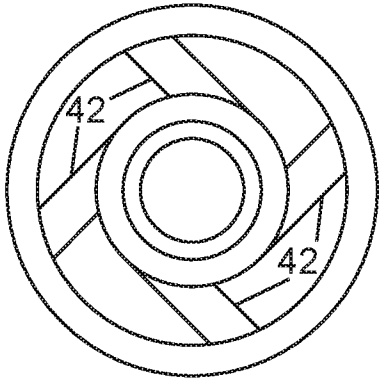
FIG. 13 shows a cross section of the FIG. 12 configuration.

FIGS. 12 and 13 show a configuration that utilizes circumferential bending of the vanes to provide diametrical variation. Note that the four vanes 42 are offset from the purely radial location of the vanes of the centralizers shown in FIGS. 7 and 11, for instance. This offset allows the vanes to flex in a circumferential direction 44 if a tight spot is encountered, as shown in FIG. 14, then rebound back to the original position after the tight spot is passed.

The invention claimed is:

1. A drive rod centralizer to position drive rods at a centerline of production tubing, comprising:

a cylindrical rotor, said cylindrical rotor being attached to the body of said drive rod, the centerline of said cylindrical rotor being collinear with the centerline of said drive rod;

a stator, said stator being comprised of a cylindrical body, said cylindrical body having an external diameter less than the internal diameter of said production tubing, and having a smooth central bore, said bore having an internal diameter larger than the external diameter of said cylindrical rotor;

wherein said stator is installed on said drive rod such that said rotor is within said central bore of said stator;

wherein said stator has several, equal length vanes projection radially outward from said cylindrical body, with the major axis of said vanes being oriented along the centerline of said stator body, the axial length of said vanes being approximately equal to the axial length of said stator body;

wherein the radially inner surface of each of said vanes is attached to the outer surface of said stator body and the radially outer surface of each of said vanes is longitudinally arc-shaped with the crest of the arc in contact with the inner surface of said production tubing, wherein some material of the body of some of said vanes is removed, forming a cavity oriented along the centerline of said stator body in some of said vanes, wherein vane material between said cavity and the outer surface of the vane flexes inward into the cavity in said vanes, so that the centralizer outer diameter is reduced to pass through one or more tight spots in the production tubing, and wherein the vanes spring back and remain in contact with the inner wall of the tubing once the one or more tight spots have been passed.

2. The drive rod centralizer of claim 1, wherein the cavity is formed completely through said vanes in the circumferential direction, wherein the dimensions of said cavity are sufficient to allow said vane material between said cavity and the outer surface of the vane to deform inward enough so an effective outer diameter of the centralizer is equal to an effective reduced inner diameter of the one or more tight spots in the tubing.

3. The drive rod centralizer of claim 1, wherein the one or more tight spots are portions of the production tubing that have an effective internal diameter reduced by as much as 4% of the specified internal diameter.

4. The drive rod centralizer of claim 1, wherein the vanes are made of a material that has natural elasticity.

5. The rod centralizer of claim 1, wherein the vanes are deformed in the radial direction.

6. The drive rod centralizer of claim 1, wherein the production tubing has a reduced effective internal diameter.

7. The drive rod centralizer of claim 1, wherein the drive rod centralizer allows for sufficient flexibility in the stator blades to allow the passage of said stator past areas of the production tubing where the effective internal diameter is as much as 4% less than the specified internal diameter of the tubing without damaging the centralizer components, and without interfering with the installation of the rod string into the production tubing.

8. The drive rod centralizer of claim 1, wherein the stator blades rebound back to full original outer diameter after multiple flexing to allow passage through areas of the tubing with reduced effective internal diameter, returning the drive rod to the centerline of the production tubing.

9. The drive rod centralizer of claim 1, wherein said cylindrical rotor and said inner bore of said stator comprise a plain bearing, said rotor comprising a journal, and said stator bore comprising a bearing, to provide the rotational axial alignment and support of said drive rod.

10. One or more drive rod centralizers of claim 1, wherein the one or more drive rod centralizers are situated along said drive rod string to prevent rotational instability during rotational operation of said drive rod string.

11. A drive rod centralizer to position drive rods at or near a centerline of the production tubing, comprising:

a cylindrical rotor, said cylindrical rotor being attached to the body of said drive rod, the centerline of said cylindrical rotor being collinear with the centerline of said drive rod;

a stator, said stator being comprised of a cylindrical body, said cylindrical body having an external diameter less than the internal diameter of said production tubing, and having a smooth central bore, said bore having an internal diameter larger than the external diameter of said cylindrical rotor;

wherein said stator is installed on said drive rod such that said rotor is within said central bore of said stator;

wherein said stator has several, equal length vanes attached to the outer surface of said cylindrical body of said stator;

wherein said vanes being attached to said stator body such that the outer circumferential surface of said vanes is tangential with the cylindrical surface of said stator;

wherein the radially outer surface of said vanes is in contact with the inner surface of said production tubing, wherein said vanes are configured to flex in a circumferential direction.

12. The drive rod centralizer of claim 11, wherein the vanes are configured to flex from a first position to a second position in a circumferential direction.

13. The drive rod centralizer of claim 11, wherein the vanes are configured to rebound back to the first position in the circumferential direction.

14. The drive rod centralizer of claim 11, wherein said cylindrical rotor and said inner bore of said stator comprise a plain bearing, said rotor comprising a journal, and said stator bore comprising a bearing, to provide the rotational axial alignment and support of said drive rod.

15. One or more drive rod centralizer of claim 11, wherein the one or more drive rod centralizers are situated along said drive rod string to prevent whirling or other rotational instability during rotational operation of said drive rod string.

16. A drive rod centralizer to position drive rods at a centerline of production tubing, comprising:

a cylindrical rotor, said cylindrical rotor being attached to the body of said drive rod, the centerline of said cylindrical rotor being collinear with the centerline of said drive rod;

a stator, said stator being comprised of a cylindrical body, said cylindrical body having an external diameter less than the internal diameter of said production tubing, and having a smooth central bore, said bore having an internal diameter larger than the external diameter of said cylindrical rotor;

wherein said stator is installed on said drive rod such that said rotor is within said central bore of said stator;

wherein said stator has several, equal length vanes projection radially outward from said cylindrical body, with the major axis of said vanes being oriented along the centerline of said stator body, the axial length of said vanes being approximately equal to the axial length of said stator body;

wherein the radially inner surface of each of said vanes is attached to the outer surface of said stator body and the radially outer surface of each of said vanes is in contact with the inner surface of said production tubing, wherein some material of the body of some of said vanes is removed, forming a cavity in some of said vanes, wherein vane material between said cavity and the outer surface of the vane flexes inward into the cavity in said vanes, so that the centralizer outer diameter is reduced to pass through a tight spot, wherein an effective internal diameter of the centralizer is as much as 4% less than the specified internal diameter of the tubing.

* * * * *